US010648253B2

(12) United States Patent
Kaasin

(10) Patent No.: US 10,648,253 B2
(45) Date of Patent: May 12, 2020

(54) MODULAR SPINNER ROLLER

(71) Applicant: Cameron International Corporation, Houston, TX (US)

(72) Inventor: Bard Henning Kaasin, Gvarv (NO)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 182 days.

(21) Appl. No.: 15/164,597

(22) Filed: May 25, 2016

(65) Prior Publication Data

US 2017/0342785 A1 Nov. 30, 2017

(51) Int. Cl.
*E21B 19/16* (2006.01)

(52) U.S. Cl.
CPC ..... *E21B 19/161* (2013.01)

(58) Field of Classification Search
CPC ..... E21B 19/16; E21B 19/161; E21B 19/164; E21B 19/168; E21B 17/042
See application file for complete search history.

(56) References Cited

U.S. PATENT DOCUMENTS 6,253,845 B1 * 7/2001 Belik ..... E21B 19/168 166/77.51
2009/0211404 A1 * 8/2009 Pedersen ..... E21B 19/164 81/57.16
2009/0272235 A1 * 11/2009 Berry ..... E21B 19/163 81/57.34

FOREIGN PATENT DOCUMENTS

EP 2118433 11/2010

* cited by examiner

*Primary Examiner* — David Carroll

(57) ABSTRACT

A spinner roller set adapted for use in an apparatus used to connect and disconnect threaded drilling tubulars includes a first and a second modular spinner roller that mounts independent drive and spacer discs on a central shaft. The setup is arranged so that the spinner rollers when in use can engage a small diameter tubular using the same setup as that for engaging a much larger diameter tubular. When a drive disc is in need of replacement, the worn drive disc can be removed from the central shaft and replaced with a new drive disc. The other drive discs and spacers can be reused.

7 Claims, 2 Drawing Sheets

MODULAR SPINNER ROLLER

BACKGROUND

This invention is directed to apparatuses such as spinners, spinning wrenches, spinning tongs, and iron or hydraulic roughnecks ("spinners") used for rotating drilling tubulars during oil and gas wellbore drilling operations.

Drilling tubulars such as drill pipe, tubing, and casing ("tubulars") are assembled by threading one section of tubular to the next. A spinner provides the clamping and rotational force needed to spin in or spin out the threaded connection. The spinner includes arms with roller assemblies that grip or clamp onto the tubular. When in the clamping position, the tubular is contacted by a set of roller assemblies. Enough clamping force must be exerted perpendicular to the tubular to counteract the rotational force.

Using small diameter rollers for spinning small (outside) diameter tubulars such as 2⅞" or less presents a problem in achieving sufficient gripping coefficient on the tubular. Therefore, larger (outside) diameter rollers—with their greater contact area and better geometry for transferring clamp force perpendicular to the torque force vector—are preferred. However, the larger diameter rollers can interfere with one another as they engage a much smaller diameter pipe. Because of the interference problem, some prior art spinners use multi-diameter rollers in which one roller provides the large contact surface and the opposing roller provides a recess to prevent interference.

EP 2 118 433 B1 discloses a set of solid body multi-diameter rollers in which one roller includes a projection and an opposing roller includes a recess for receiving at least part of the projection. The roller has no central shaft but is instead connected to the drive shaft of the spinner motor by way of an upper spindle. When one roller wears, the entire roller assembly must be replaced.

A need exists to spin small diameter pipe with large diameter rollers yet avoid the interference problem and complete roller replacement problem.

SUMMARY

A preferred embodiment of a spinner roller is made of up of a single- or, more preferably, a multi-diameter stack of independent drive discs and independent spacer discs arranged in a predetermined pattern. (The single diameter embodiment is generally preferred for spinning tubular where a lower surface pressure is preferred.) A center shaft supports the drive discs and spacer discs and transmits torque to the drive discs. Because the spinner roller is a modular assembly, when the drive discs wear out the center shaft and spacer discs can be reused.

Objectives of this invention include providing a modular spinner roller that (1) can replace one or more drive discs without replacing the entire roller; (2) uses large diameter rollers to spin large to small tubulars yet avoid the interference effects associated with large diameter rollers when spinning small diameter pipe; (3) can be used in retrofits of existing spinners; and (4) improves maintainability and reduces maintenance and replacement costs.

NUMBERING AND ELEMENTS USED IN THE DRAWINGS AND DETAILED DESCRIPTION

Figure 2:
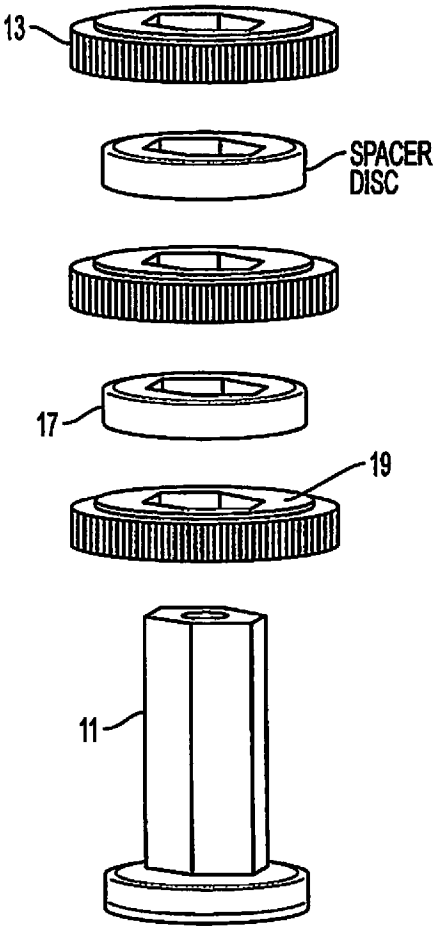
FIG. 2 is an exploded assembly view of the spinner roller of FIG. 1.

10 First modular spinner roller assembly
11 Center or central shaft
13 Independent drive disc
15 Spaced-apart grooves
17 Independent spacer disc
19 Central opening
20 Second modular spinner roller assembly
21 Recess (provided by 17 relative to 13)

DETAILED DESCRIPTION OF THE PREFERRED EMBODIMENTS

Figure 1:
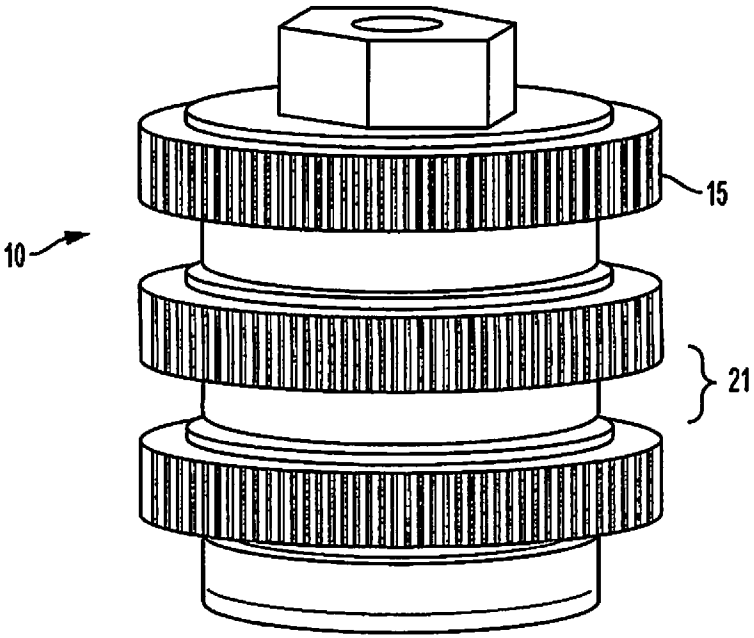
FIG. 1 is an isometric view of a preferred embodiment of an assembled multi-diameter spinner roller for use in spinners such as, but not limited to, a JIM 10™ hydraulic roughneck (Cameron International Corporation).
Figure 3:
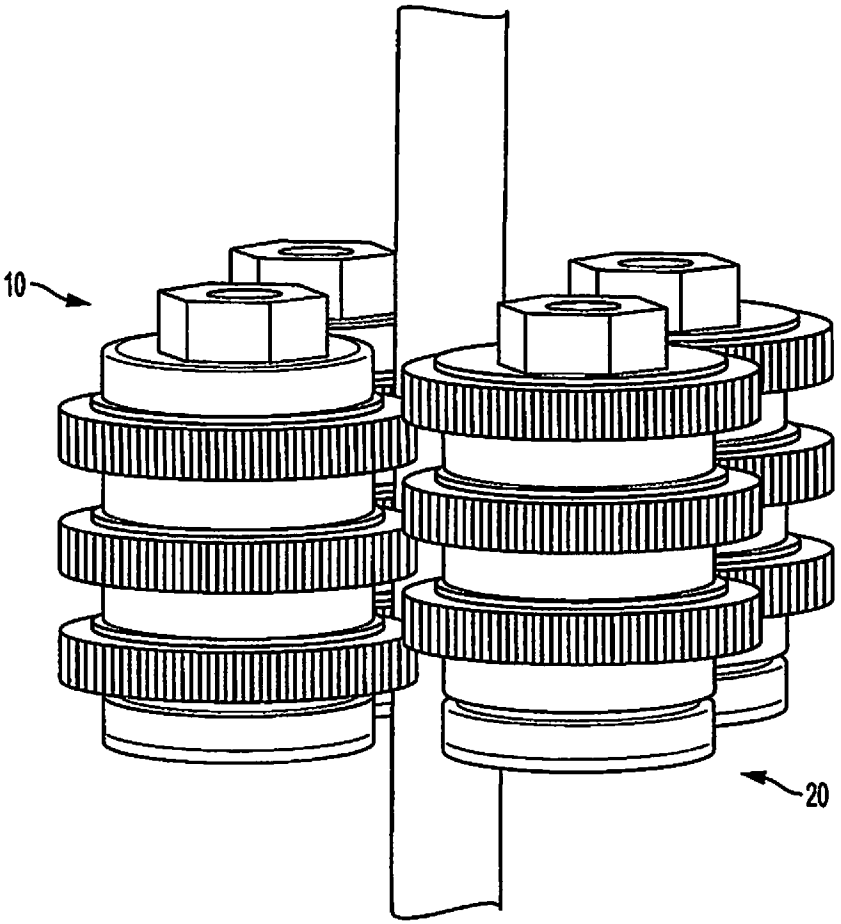
FIG. 3 is an isometric view of a setup of four spinner rollers engaging a small diameter (e.g. 2⅞" or 2⅜") tubular using the same setup as that for engaging a much larger diameter (e.g. 10") tubular.

Referring to FIGS. 1 to 3, a modular spinner roller 10 for use in an apparatus used to connect and disconnect threaded pipe includes a central shaft 11 that receives an alternating set of independent drive discs 13 and spacer discs 17. When in use in the apparatus, the discs 13 contact and engage the outside diameter of the pipe sections being connected or disconnected. The drive discs 13 can have a smooth or flat surface or can include a series of spaced-apart grooves or threads 15 that gives improved grip (increasing friction) or can channel away any fluids lying on the outside diameter of the pipe sections (thereby increasing friction with the pipe).

The drive and spacer discs 13, 17 have a central opening 19 that is complementary in shape to the central shaft 11 to prevent relative rotation of the discs 13, 17 relative to the shaft 11 and transmit torque from the central shaft 11 to the drive disc 13. When the drive discs 13 wear out, the drive discs 13 along with the spacer discs 13 can be removed from the central shaft 11 and replaced.

The drive discs 13 and spacer discs 17 can have the same outside diameter as one another, making spinner roller 10 a single diameter stack. Or, the discs 13, 17 can have different outside diameters than one another, making spinner roller 10 a multi-diameter stack. The drive discs 13 may also have different surfaces than one another (e.g. one flat or smooth, another grooved or threaded).

When used as part of a spinner roller set, the drive discs 13 and spacer discs 17 of opposing modular spinner rollers 10, 20 can be offset from another. In this way, the spacer disc 17 of the second modular spinner roller 20 provides a recess 21 to receive the drive disc 13 of the first modular spacer roller 10.

The modular spinner roller permits a worn drive disc to be replaced and the remaining drive discs to be reused. A method includes the steps of removing one or more independent drive discs and spacers from a central shaft of the spinner roller and replacing the worn drive disc with a new independent drive disc mounted on the central shaft. Any other removed but not worn-out drive disc and spacer disc can also be re-mounted onto the central shaft.

The preferred embodiments described above and illustrated in the drawing figures provide examples of the modular spinner roller. The following claims define the inventive spinner roller and cover the full range of equivalents to which the recited elements of the claims are entitled.

What is claimed:

1. A spinner roller set adapted for use in an apparatus used to connect and disconnect threaded drilling tubulars, the spinner roller set comprising:

a first and a second modular spinner roller, the first and second modular spinner rollers including:

a central shaft spanning a top to bottom distance of the spinner roller; and at least two independent drive discs mounted on and removable from the central shaft and spaced apart from one another by a spacer disc that is separately mounted on and removable from the central shaft;

wherein said drive discs and said spacer discs receive only said central shaft;

wherein said spacer disc has a different outside diameter than said drive discs wherein the drive discs and the spacer disc having a non-circular central opening complementary in shape to the central shaft.

2. A spinner roller set according to claim 1 further comprising one of the drive discs of the first modular spinner roller being arranged opposite a spacer disc of the second modular spinner roller.

3. A spinner roller set according to claim 1 wherein said drive disks have a first outside surface and said spacer disks have a second outside surface, wherein said surfaces are different from one another.

4. A spinner roller adapted for use in an apparatus used to connect and disconnect threaded drilling tubulars, the spinner roller comprising:

a central shaft spanning a top to bottom distance of the spinner roller; and at least two independent drive discs mounted on and removable from the central shaft and spaced apart from one another by a spacer disc that is separately mounted on and removable from the central shaft;

wherein said spacer disc has a different outside diameter than said drive discs;

wherein the drive discs and the spacer disc having only a single non-circular central opening complementary in shape to the central shaft.

5. A method of replacing a worn spinner roller use in an apparatus used to connect and disconnect threaded drilling tubulars, the method comprising the steps of:

separately removing one or more drive discs and spacers from a central shaft of the spinner roller, at least one of the separately removed drive discs being a worn drive disc in need of replacement wherein said spacers having a smaller outside diameter than said one or more drive discs; and replacing the worn drive disc with a new drive disc, the new drive disc being mounted on the central shaft; and reusing and replacing said spacer, said spacer being mounted on the central drive shaft;

wherein said drive discs and said spacer discs receive only said central shaft.

6. A method according to claim 5 further comprising the drive discs and the spacer disc having a non-circular central opening complementary in shape to the central shaft.

7. A method according to claim 5 wherein said drive disks have a first outside surface and said spacer disks have a second outside surface, wherein said surfaces are different from one another.

* * * * *